US007398942B2

(12) United States Patent
Benvenuti et al.

(10) Patent No.: US 7,398,942 B2
(45) Date of Patent: Jul. 15, 2008

(54) REWINDING MACHINE TO PRODUCE LOGS OF WEB MATERIAL AND RELATIVE WINDING METHOD

(75) Inventors: Angelo Benvenuti, Lucca (IT); Romano Maddaleni, Pisa (IT); Graziano Mazzaccherini, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 318 days.

(21) Appl. No.: 10/510,576

(22) PCT Filed: Feb. 9, 2004

(86) PCT No.: PCT/IT2004/000049

§ 371 (c)(1),
(2), (4) Date: Oct. 8, 2004

(87) PCT Pub. No.: WO2004/071914

PCT Pub. Date: Aug. 26, 2004

(65) Prior Publication Data

US 2005/0139714 A1 Jun. 30, 2005

(30) Foreign Application Priority Data

Feb. 12, 2003 (IT) ..... FI2003 A 0036

(51) Int. Cl.
*B65H 35/08* (2006.01)

(52) U.S. Cl. ..... 242/527; 242/527.2; 242/527.3; 242/527.4

(58) Field of Classification Search ..... 242/542, 242/527, 527.2, 527.3, 527.4, 525
See application file for complete search history.

(56) References Cited

U.S. PATENT DOCUMENTS

| | | | | |
|---|---|---|---|---|
| 3,072,353 | A | 1/1963 | Moser | |
| 3,918,654 | A * | 11/1975 | Okubo et al. | 242/527.2 |
| 4,422,588 | A | 12/1983 | Nowisch | |
| 5,257,748 | A * | 11/1993 | Morizzo | 242/527 |
| 6,129,304 | A | 10/2000 | Biagiotti | |
| 6,143,111 | A * | 11/2000 | Biagiotti | 156/152 |
| 2003/0001042 | A1 * | 1/2003 | Betti et al. | 242/527 |
| 2004/0256513 | A1 * | 12/2004 | Perini | 242/521 |

FOREIGN PATENT DOCUMENTS

| | | | |
|---|---|---|---|
| EP | 0 622 321 | A2 | 11/1994 |
| EP | 0 622 321 | A3 | 11/1994 |
| WO | WO 99/02439 | A1 | 1/1999 |

* cited by examiner

*Primary Examiner*—Peter M. Cuomo
*Assistant Examiner*—Sang Kim
(74) *Attorney, Agent, or Firm*—Breiner & Breiner, LLC

(57) ABSTRACT

The machine comprises in combination: a winding cradle (7); an insertion member (29) to insert winding cores (A, A1) into said cradle; an ejector (39) to eject the logs formed from said cradle (7) causing them to roll on an unloading chute (41); a severing device (55, 53) to sever the web material after ejection of the log from said cradle. Disposed along the unloading chute is an aperture (43) elongated in a direction transverse to the direction in which the log is unloaded along said unloading chute. Moreover, the severing device (53, 55) includes a movable element (55) that is inserted into said aperture (43) to cause severing of the web material between the cradle and the finished log.

44 Claims, 9 Drawing Sheets

REWINDING MACHINE TO PRODUCE LOGS OF WEB MATERIAL AND RELATIVE WINDING METHOD

TECHNICAL FIELD

The present invention relates to a machine for producing logs of wound web material. More specifically, the invention relates to a rewinding machine of the peripheral type, that is wherein a log of web material is formed in a cradle defined by members in contact with the periphery of the log being formed. These members are typically constituted by winding rollers.

More specifically, the invention relates to a rewinding machine with discontinuous, that is start-stop, operation. In these machines the web material is fed continuously in the winding cradle until completion of the log. At this point the feed speed of the web material is reduced or feed is stopped, to allow unloading of the finished log, insertion of a new winding core and cutting of the web material, as well as adhesion of the leading edge produced by cutting or severing the web material to the new winding core.

The invention also relates to a winding method to produce logs of web material wound around central winding cores.

STATE OF THE ART

To produce logs of paper, non-woven and other web materials, rewinding machines are used wherein the log being formed is in contact with the winding rollers that transmit the rotatory motion to the log. In particular, winding machines of the start-stop type are used to produce logs with relatively large diameters, especially for limited production quantities. Examples of machines of this type are described in WO-A-9902439 (equivalent to U.S. Pat. No. 6,129,304) and in. U.S. Pat. No. 4,422,588.

WO-A-9902439 describes a rewinding machine of the start-stop type comprising in combination:

- a first winding roller and a second winding roller defining a supporting and winding cradle for a log being formed;
- an insertion member to insert winding cores into said cradle;
- an ejector to eject the formed logs from said cradle causing them to roll on an unloading chute;
- a severing device to sever the web material upon termination of winding each log, after the log has been ejected from said cradle.

Upon termination of winding a log the web material is cut and a glue is applied parallel to the edge of the trailing edge by means of a nozzle that translates in a direction parallel to the direction of the winding axis of the log. The nozzle to apply the glue to the trailing edge of the log is carried by a carriage that translates parallel to the axis of the winding rollers of the rewinding machine and that carries a second nozzle to apply a glue to a new winding core which is inserted into the winding cradle. Application of the glue is a thus a particularly lengthy operation, especially when the web material treated by the machine is of considerable width. In addition to the two nozzles, the carriage also carries a cutting blade to cut the web material crosswise. The translation speed of the carriage is therefore also limited by the need to perform this crosswise cutting operation in a reliable way.

In WO-A-9902439 winding is performed simultaneously on a series of tubular winding cores aligned with one another, cutting the web material into strips of the desired width before said material is wound into a log. However, winding may be performed on a single tubular core or on a single spindle, i.e. of approximately the same length as the width of the web material to be wound.

Hereinafter, reference will be made in general to a log being formed, this being intended as a single log wound on a single winding core, or a series of smaller logs (that is, with a reduced axial length) wound simultaneously on a plurality of cores aligned with one another.

OBJECTS AND SUMMARY OF THE INVENTION

The object of the present invention is to provide a rewinding machine, especially of the start-stop type, which is particularly efficient and overcomes specific drawbacks of traditional machines and in particular allows the production cycle to be speeded up.

The object of a preferred embodiment of the invention is to provide a rewinding machine that can wind the web material with the same efficiency on a single core or on several aligned cores, after cutting the web material longitudinally into strips.

Essentially, according to a first aspect of the invention, a peripheral rewinding machine of the start-stop type is provided, wherein:

- disposed along the chute to unload the log from the winding core is an aperture which extends in a direction transverse to the direction in which the log is unloaded along said unloading chute;
- and said severing device comprises a movable element that is inserted into said aperture to cause severing of the web material between the cradle and the finished log.

In this way upon termination of winding the log the web material is cut extremely rapidly by inserting the movable element into the transverse aperture provided on the unloading chute. This makes it possible, for example, to start winding a new log before the trailing edge of the just completed log has been sealed and for gluing of the latter to take place during winding of the new log.

According to a particularly advantageous embodiment of the invention, a first glue container can be disposed underneath the elongated transverse aperture provided on the unloading chute of the logs; associated with this is a first movable dispensing member that collects the glue from the container to apply it to the finished log ejected from the winding cradle.

Winding means may also advantageously be provided to wind the trailing edge of the log after the glue has been applied; these can define a stop position of the ejected log on said unloading chute, in which position the glue is applied.

According to a particularly advantageous embodiment of the invention, to guarantee fail safe severing of the web material and reliable and fail safe operation of the severing device, in addition to the movable element, this device includes a blade fitted along the aperture provided on the unloading chute of the log, with which the movable element cooperates. The blade may be a serrated blade. Although it is possible for the blade to be provided on the movable element, positioning of a fixed blade along the edge of the aperture makes the machine safer. Moreover, to obtain even more reliable operation, the blade may be associated with the edge of the transverse aperture downstream with respect to the log unloading direction. In this way, there is no risk of the web material not being cut and remaining unbroken and being partially unwound from the formed log by following the movement of the movable element.

In a modified embodiment, the movable element is provided with resilient pressure strips arranged on the two sides of a rigid member, such as a blade. The pressure strips pinch the web material against the edges of the elongated aperture during web severing, while the rigid member enters the aperture and cuts or tears the web. The fixed blade along the edge of the aperture can be dispensed with in this case.

Advantageously, the width of the aperture, that is its dimension in the direction in which the logs are unloaded; is such that when the movable element of the severing device is in said aperture, the first movable dispensing member can pass through said aperture. In this way the movements of the members required to cut or sever the web material and to glue the log may overlap in time to reduce the duration of the operating cycle.

In a particularly advantageous embodiment of the invention, the movable element of the device to sever the web material is carried by a pair of oscillating arms. These arms may in turn support a third winding roller, which thus has a movable axis so that it can rise gradually during winding of the log being formed in the winding cradle and move away from the log to allow unloading upon termination of winding. This roller may be motorized. This layout reduces the number of movable members of the machine, reducing the cost and making it simpler and consequently more reliable.

According to a different embodiment of the invention, the movable element of the device to sever the web material is carried by a pair of oscillating arms different from the oscillating arms which support said third winding roller. As will be explained in more detail later on, this arrangement allows the movement of the severing device to be independent of the movement of the third roller. This can be useful when it is required to handle cores of various differing diameters with the same machine.

In a preferred and improved embodiment of the rewinding machine according to the invention, disposed underneath the winding cradle is a second glue container, associated to which is a second movable dispensing member, to apply a glue to the winding cores when they are located in the cradle.

To insert the winding cores into the winding cradle, disposed on the opposite side of said cradle with respect to the unloading chute for the finished logs is a winding core supporting surface, said insertion member pushing the winding cores from said surface into said cradle.

To produce a simpler structure and reduce the number of actuators required to control the movements of the various members of the machine, according to a preferred embodiment of the invention, the ejector and the insertion member are integral with each other so that they can be controlled by a single actuator. For example, the ejector can be formed of a pair of sides between which a pusher section extends to eject the finished logs from the winding cradle, and with which the insertion member is integral, the ejector and the insertion member being spaced from each other in the direction of the movement to insert the cores and to eject the logs. In this case it is also possible to provide means to feed the cores to place said cores in an intermediate position between the insertion member and the ejector when they are in a withdrawn position.

These feeding means may have various configurations according to the type of winding to be obtained. For example, when winding is performed on a single tubular core or on a single spindle of a length essentially equal to the width of the web material to be wound, the winding cores or spindles can be inserted along a channel that extends above the supporting surface for the winding cores. Feed takes place in this case by dropping the cores from a container overhead. When, on the other hand, winding is performed after having cut the web material longitudinally, on a plurality of winding cores aligned with one another in the axial direction, these cores must be inserted in a specific position on the supporting surface. For this purpose a conveyor belt may for example be provided to feed the cores in a direction parallel to their axis and therefore orthogonal to the direction of feed of the web material in the rewinding machine.

The two feed systems may both be provided on the same machine, so that it can work alternately in one mode or in the other.

In an advantageous embodiment both the first and the second movable glue dispensing members to apply glue respectively to the finished log and to the new winding core(s) inserted into the winding cradle have an elongated element provided with an oscillating movement.

When the rewinding machine is produced to wind several strips of web material simultaneously around winding cores aligned with one another in the axial direction, a plurality of cutting knives are advantageously provided to cut the web material along longitudinal cutting lines, cooperating with respective counter-blades constituted by a plurality of annular channels produced on a counter-roller. Advantageously, in this case a series of ply-bonding members, cooperating with said counter-roller, may be provided. In this way a single element—that is the counter-roller—performs the dual function of counter-blade for the cutting knives and counter-pressure member for the ply-bonding wheels. This configuration of the longitudinal cutting members to divide the web material into strips and ply-bonding members can be adopted in rewinding machines differing from the one forming the object of the present invention and in general also in machines of other types, each time a web material requires to be divided into strips, where the web material is composed of two or more plies which must be bonded with one another by ply-bonding.

According to a different aspect, the present invention relates to a method to produce logs of web material, comprising the steps of:

- inserting a first winding core into a winding cradle formed by a pair of winding rollers;
- winding a pre-determined quantity of web material around said at least one winding core to form a log;
- unloading the log formed from said winding cradle along an unloading chute;
- inserting a second winding core into said cradle;
- severing the web material between said log and said second winding core by means of a severing device;

and wherein:

- arranged along said unloading chute is an aperture extending in a direction transverse to the direction in which the log is unloaded along said unloading chute
- a first glue container is disposed underneath said aperture;
- said web material is severed by a movable element of said severing device, inserting said movable element into said aperture;
- a glue is applied to the log unloaded on said unloading chute by means of a first movable dispensing member that collects glue from said first container.

Further advantageous characteristics and embodiments of the rewinding machine and of the winding method according to the present invention are indicated in the appended claims.

BRIEF DESCRIPTION OF THE DRAWINGS

The invention will now be better understood by following the description and accompanying drawing, which shows a non-limiting practical embodiment of the invention. More specifically, in the drawing.

DETAILED DESCRIPTION OF THE PREFERRED EMBODIMENT OF THE INVENTION

Figure 1:
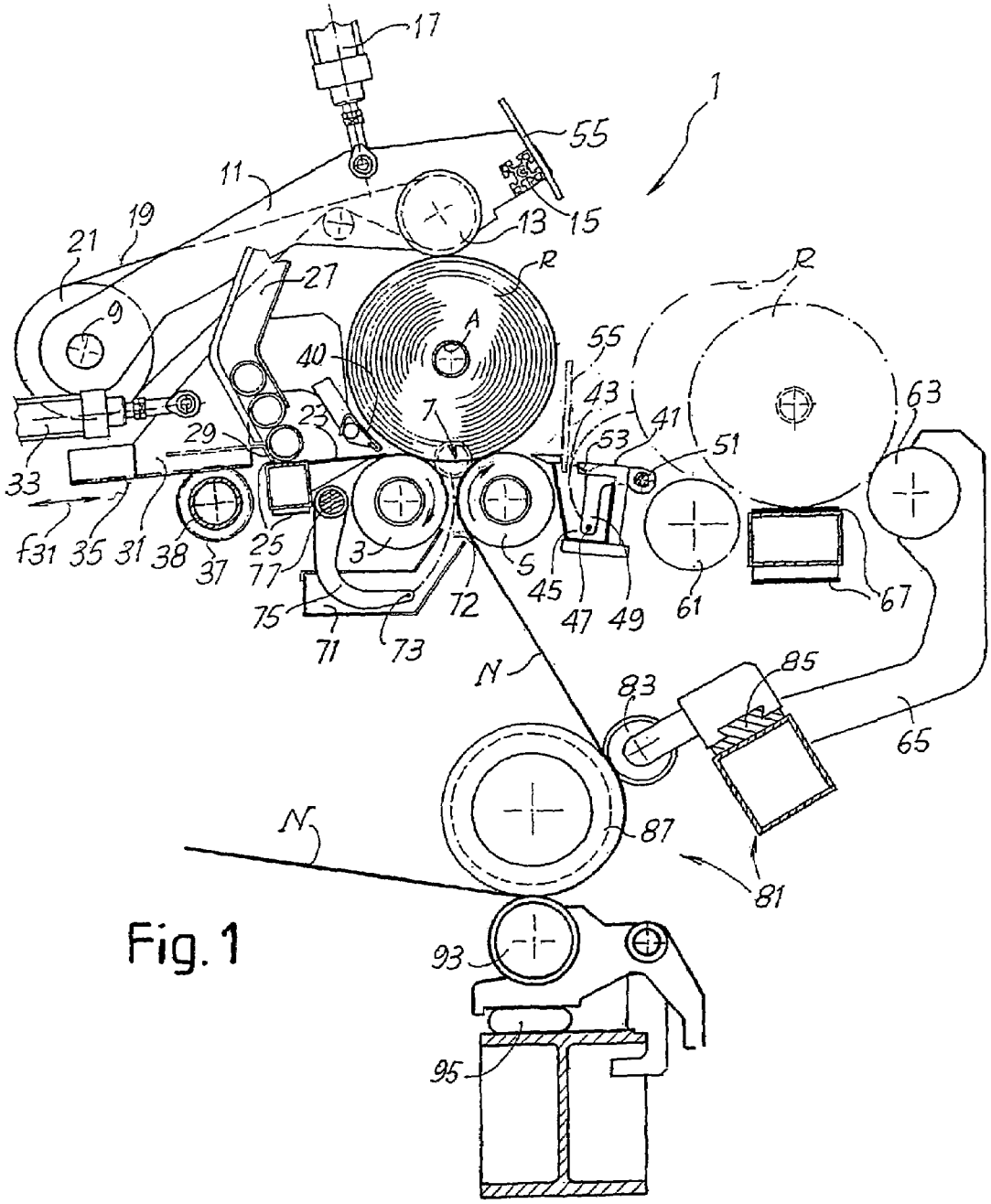
FIG. 1 shows a schematic side view of the main elements of the rewinding machine according to the invention.

Referring first to FIG. 1, the rewinding machine (shown generically at 1) is comprised of a first winding roller 3 and a second winding roller 5 which define a winding cradle 7. The winding rollers 3, 5 are disposed with parallel axes and at a distance such that the nip between them has a smaller dimension than the minimum diameter of the winding core usable with this machine. In this way the winding core (single or multiple) or the winding spindle is inserted from above and supported on the pair of rollers without going through the nip between them.

A pair of oscillating arms 11 carrying a third winding roller 13, with its axis parallel to the axes of the winding rollers 3, 5, are hinged around an axis of oscillation 9. The oscillating arms 11 are connected to each other by a crosspiece 15 and their oscillation is caused by the increase in the diameter of the log being formed and, upon termination of winding, is controlled by an actuator, for example a piston-cylinder actuator, 17. The third winding roller 13 is made to rotate by means of a belt 19 that takes its movement from a pulley 21 in turn motorized by a motor (not shown), which may be the same one that operates the two winding rollers 3, 5.

An essentially flat surface 23, to support the winding cores to be inserted into the winding cradle 7, is disposed on the left of the winding cradle 7 (observing FIG. 1). The cores can be carried to the surface 23 by means of a belt conveyor 25 (shown in a cross section in FIG. 1), which inserts one or more cores aligned with one another with a transverse movement parallel to the axis of said cores. Alternatively, the winding cores may be carried to the surface 23 by making them drop by gravity along a channel 27 positioned above, wherein said cores are inserted from a container (not shown), for example a hopper. The transverse dimension of the channel 27 may be adjusted to insert winding cores with diameters of various dimensions.

To insert the winding cores (carried by one or by the other insertion means to the surface 23) into the winding cradle 7 an insertion member 29 is provided, comprising a transverse section integral with a pair of sides 31 parallel with each other. The two sides 31 are provided with a translatory movement according to the double arrow f31, controlled by a piston-cylinder actuator 33, connected to one of the two sides 31, the movement being transmitted to the other side with a system comprising racks 35 and pinions 37 and a torsion bar 38.

A further section 39 is integral with the two sides 31, parallel to the section 29, which forms part of an ejector that ejects the completed logs of web material from the winding cradle 7.

A discontinuous unloading surface 41 is disposed on the opposed side of the cradle 7 with respect to the surface 23. Along the unloading surface 41 on which the logs formed arid unloaded from the winding cradle 7 roll, a transverse aperture 43 is provided, extending approximately for the entire width of the surface in the direction orthogonal to the plane in FIG. 1. Disposed underneath the unloading surface 41 is a glue container 45, inside which a movable dispensing member is positioned, comprising an elongated element 47 constituted by a bar or by a wire or another similar element, extending orthogonal to the plane of FIG. 1 and carried by a pair of oscillating arms 49. The movable dispensing member formed of the wire 47 can oscillate around an oscillation axis 51 to be carried out of the aperture 43 until it touches the surface of a log positioned in the gluing position as shown with the dashed line in FIG. 1 and as shall be better described hereunder with reference to the sequence illustrated in FIGS. 2 to 10.

A blade 53, advantageously a serrated blade, is applied along the longitudinal edge of the aperture 43 farthest from the winding cradle 7 (that is downstream with respect to the movement of the log unloaded from the winding cradle) for the purposes to be clarified hereunder.

A movable element 55 is connected to the pair of oscillating arms 11, along the crosspiece 15 that joins them; this element cooperates with the aperture 43 and with the blade 53 penetrating the aperture 43 in the way to be described hereunder, to perform cutting or severing of the web material upon termination of winding each log.

The log that is in the gluing position is held there by a pair of rollers 61, 63. The first of these has a fixed axis while the second is carried by movable arms 65, the oscillation of which allows the log to be unloaded onto a conveyor belt 67 disposed in an intermediate position between the rollers 61 and 63, when the roller 63 is disposed in its lowered position. One or both of the rollers 61 and 63 are motorized, to rotate the finished log located in the gluing position for the purposes described hereunder.

A second glue container 71 is disposed underneath the winding roller 3 with an aperture 72 disposed approximately at the winding cradle 7, underneath the nip formed by the winding rollers 3, 5. A second dispensing element 73 carried by a pair of arms 75 oscillating around an oscillation axis 77 is immersed in the container 71. The conformation of the arms 75 and the position of the axis of oscillation 77 are such that the oscillating movement of the elongated element 73 (which as in the case of the element 47 may be a wire, a bar or the like, extending orthogonal to the plane of FIG. 1) make the element pass through the nip between the winding rollers 3, 5 and emerge in the winding cradle 7 to touch the winding core(s) supported on it. This allows the glue to be transferred to the downward facing surface of the winding core(s) ready to start a winding cycle.

Figure 11:
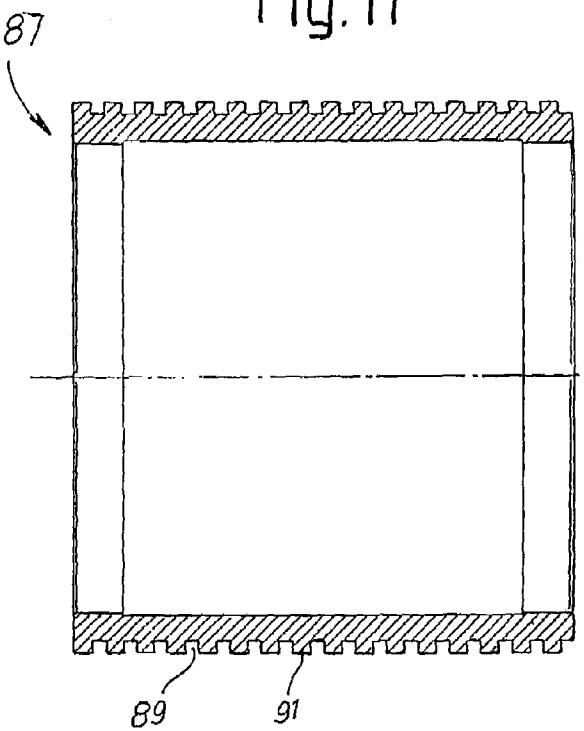
FIG. 11 shows a longitudinal section of the counter-roller.
Figure 10:
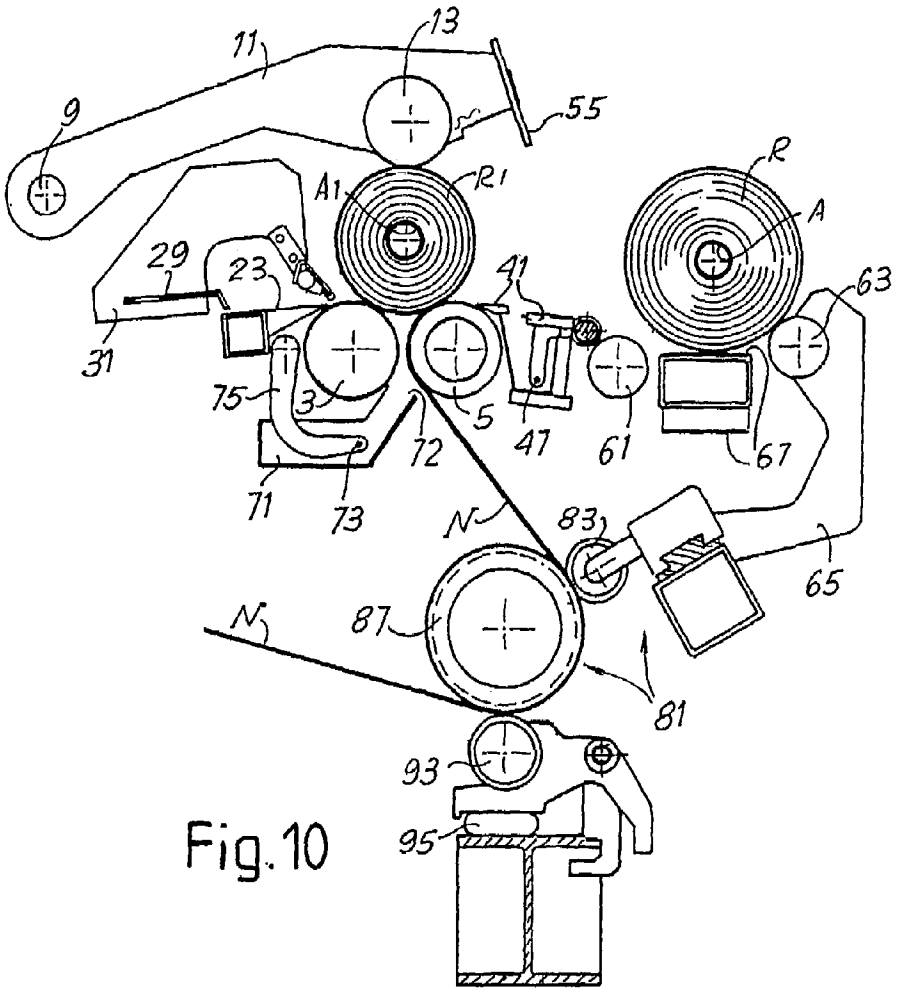
Figure 12B:
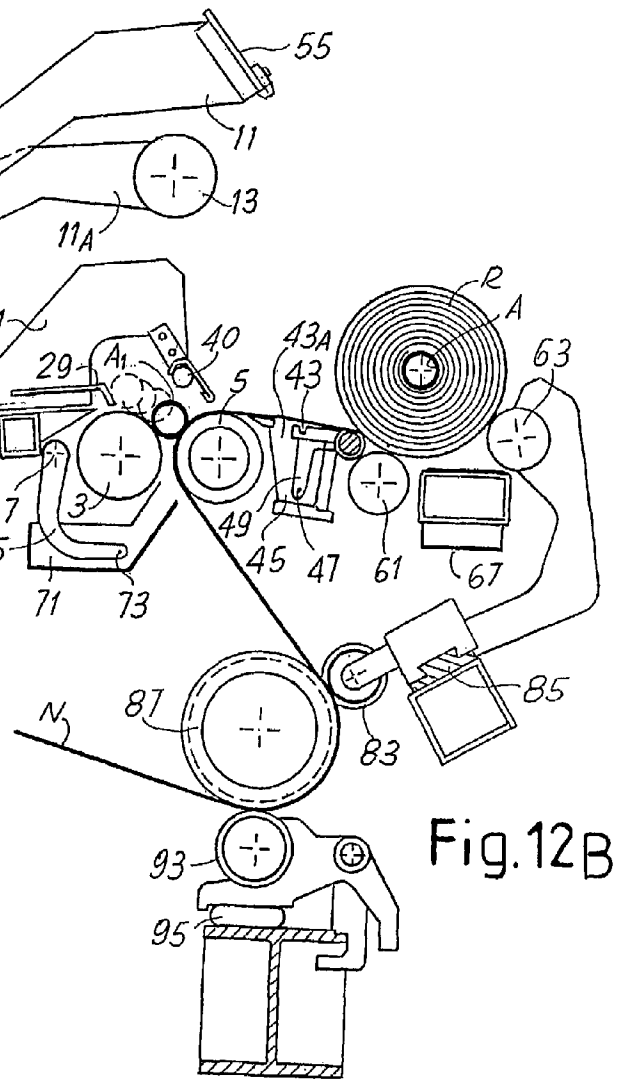
FIGS. 12A-12E show a sequence of operating steps of a second embodiment of the rewinding machine according to the invention.
Figure 12A:
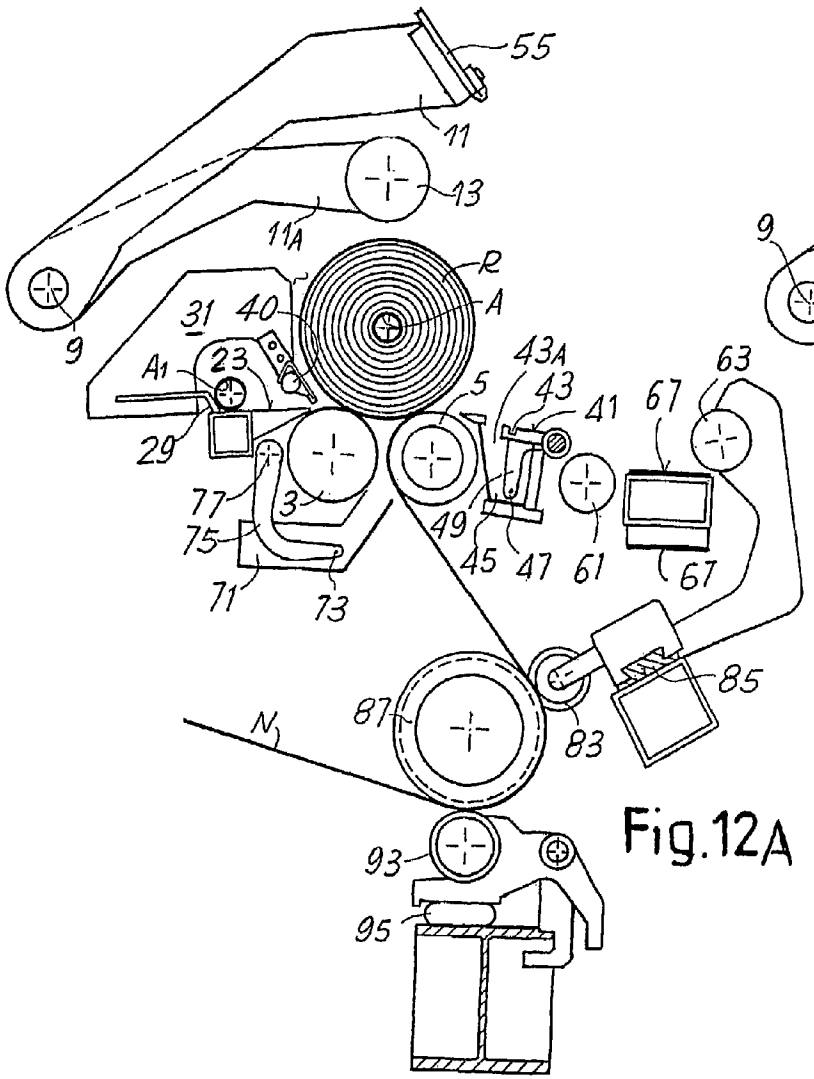
Figure 12D:
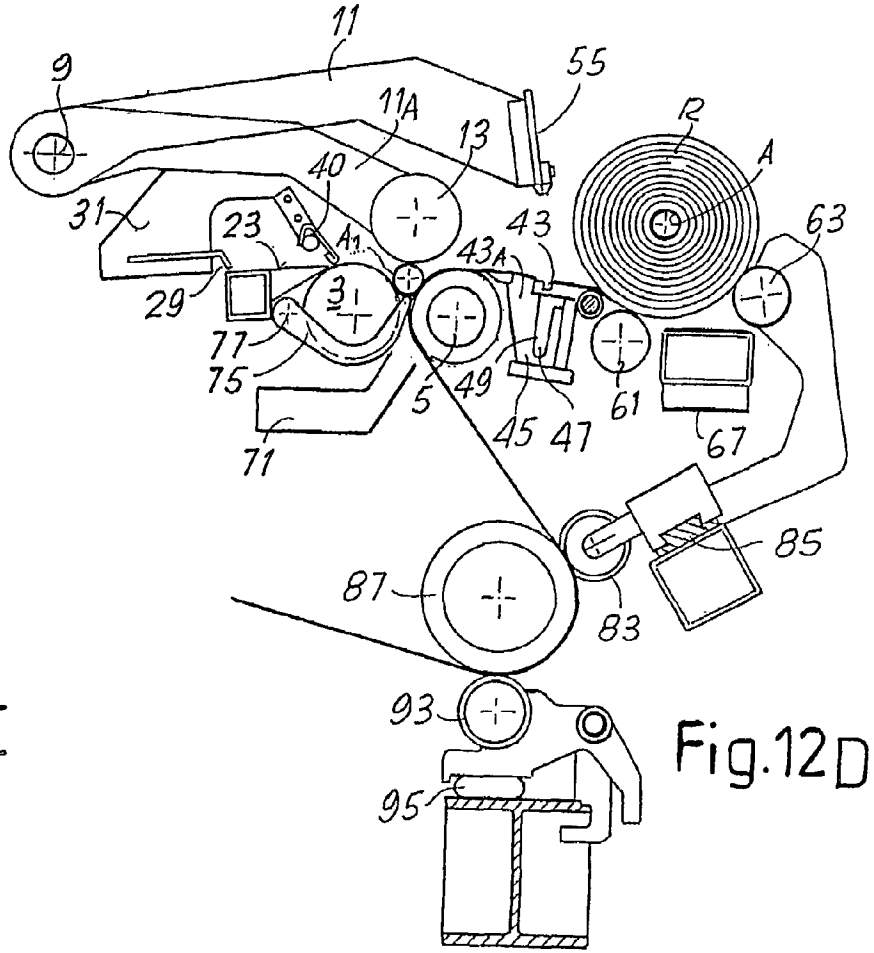
Figure 12C:
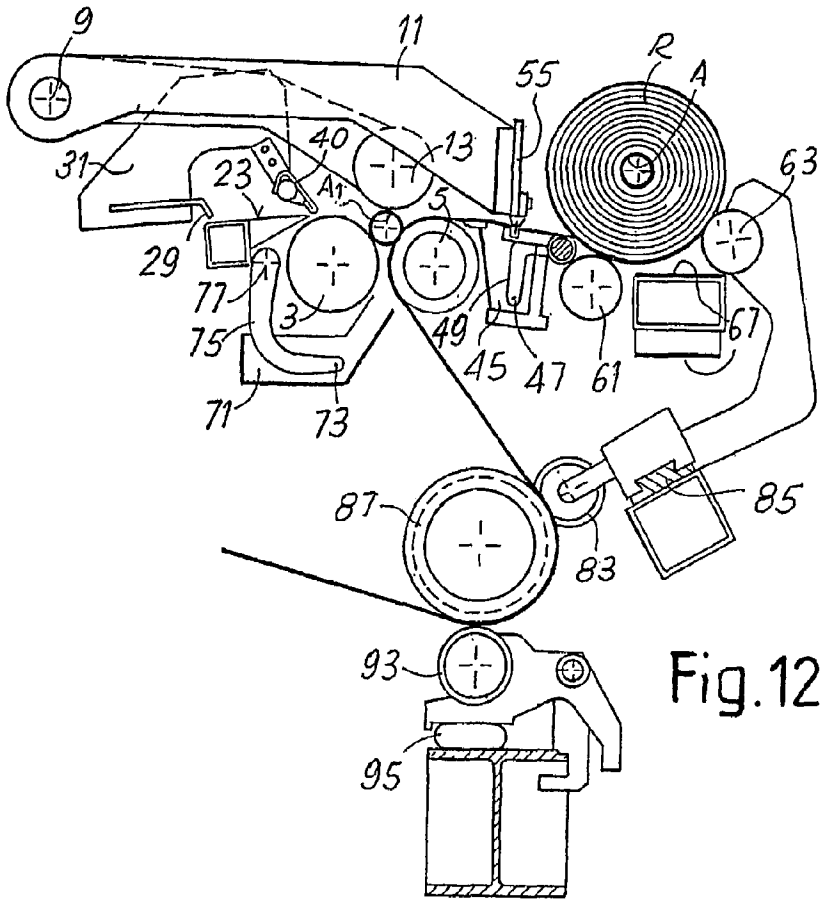

A cutting and ply-bonding unit indicated as a whole with 81, is disposed along the path of the web material N, which is wound around the winding roller 5. This unit comprises a series of disk-shaped knives 83 positioned crosswise along a guide 85, in order to position any number of knives along the width of the web material and in the desired position. These cooperate with a counter-roller with the conformation shown in FIG. 11. This is provided with a series of annular grooves 89 relatively close to one another. For example the grooves 89 (which may be a few millimeters and typically 3-7 mm in width) are spaced by annular projections 91 of the same width as, or slightly wider than, the actual grooves. Knurled ply-bonding wheels 93, pushed at high pressure against the counter-roller 84 by means of inflatable plenum chambers 95 are disposed in an angularly staggered position, for example of around 120°, with respect to the position of the knives 83, along the periphery of the counter-roller 87. The high pressure exerted by the wheels 93 on the annular projections 91 of the counter-roller 87 causes the plies (for example two or more) forming the web material N to bond through ply-bonding. The wheels 93 and the plenum chamber 95 may be produced for example as described in the U.S. Pat. No. 5,433,817.

Operation of the rewinding machine described hereinbefore is clearly illustrated in the sequence in FIGS. 2 to 10 to which reference shall now be made.

Figure 2:
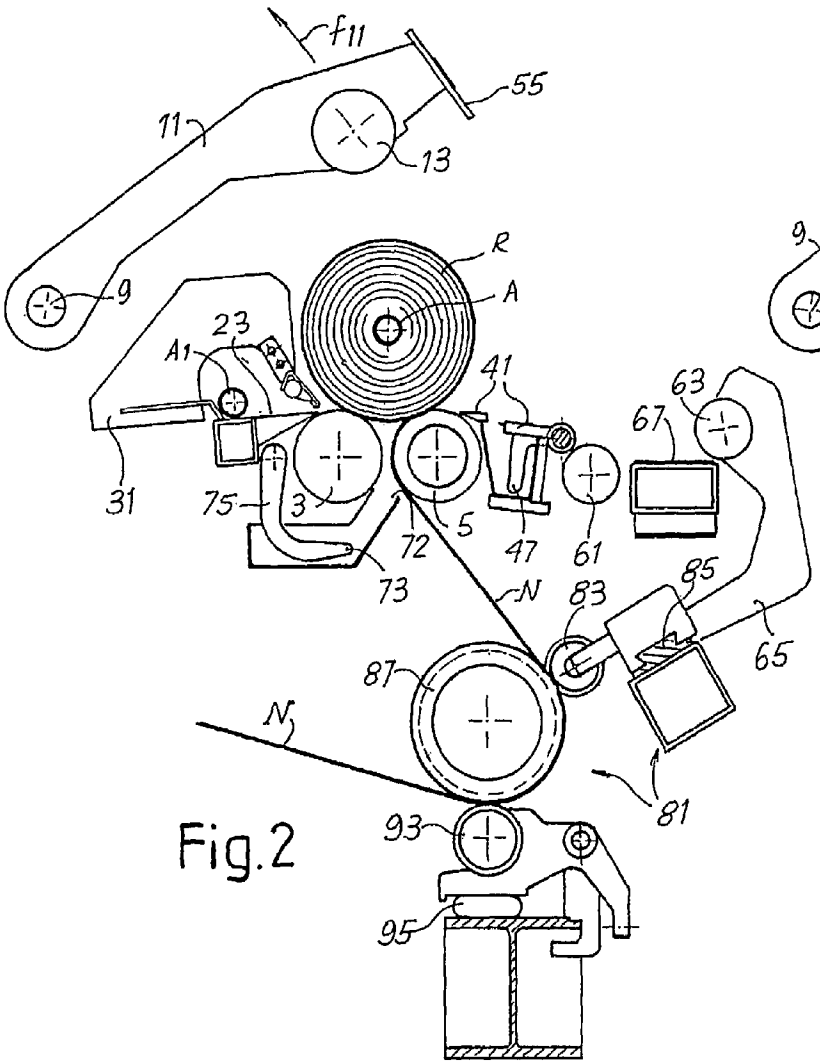

In FIG. 2 a log R in the completion phase of winding around a tubular core A is positioned in the winding cradle 7. As mentioned, the log may actually be formed of a plurality of rolls which are axially aligned and wound on winding cores aligned with one another. Upon termination of winding, the oscillating arms 11 are lifted according to the arrow f11 to remove the third winding roller 13 from the completed log and allow it to be ejected from the winding cradle 7.

A new winding core A1, or a series of winding cores aligned with one another, has been carried to the surface 23, by means of the channel 27 or the conveyor belt 25. The movable glue dispensing members are both immersed in the respective containers 45 and 71.

Figure 3:
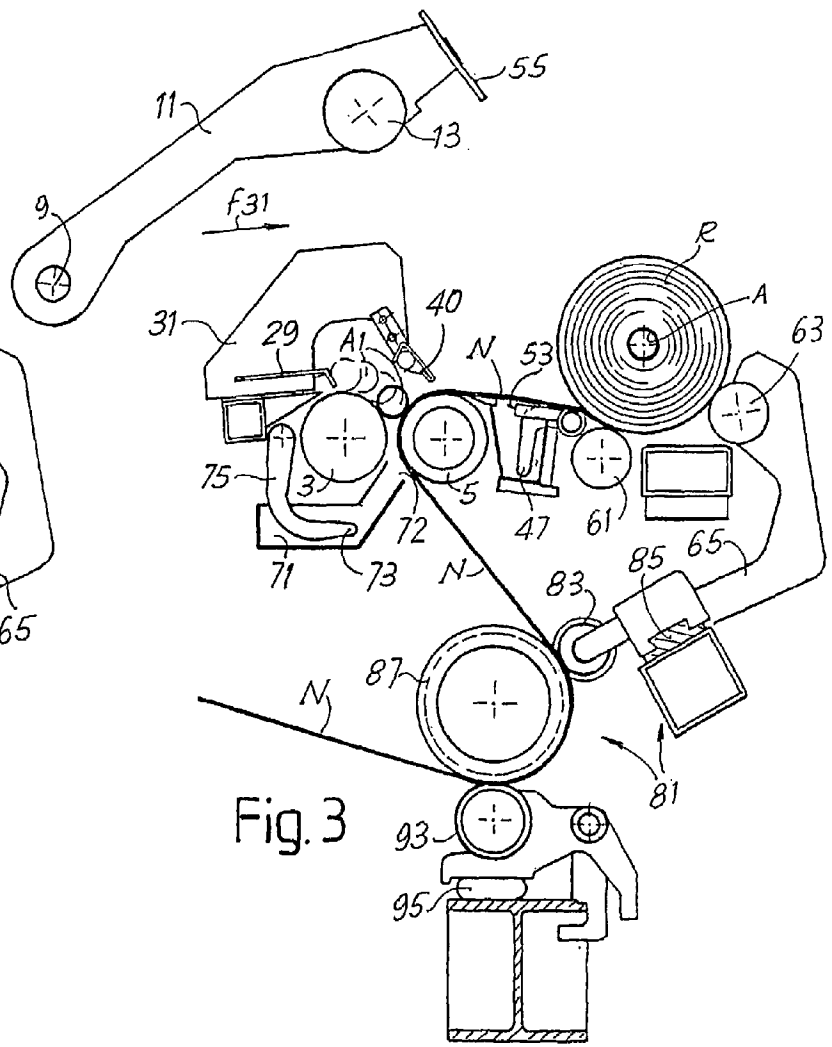
FIGS. 2 to 10 show a sequence of operating steps of the rewinding machine.

In FIG. 3 a movement from left to right of the sides 31 with the sections 29 and 39 integral with them has caused insertion of the new core(s) A1 into the winding cradle 7 and ejection of the formed log R that rolls on the surface 41 to the gluing position defined by the rollers 61 and 63. The rolling movement of the log on the surface 41 is in the direction to cause partial unwinding of the last portion of web material wound on the log. Therefore, a length of web material that is still integral and must be cut extends between the new core inserted in the winding cradle 7 and the finished log which is now in the gluing position. Feed of the web material towards the winding rollers has been interrupted.

Figure 5:
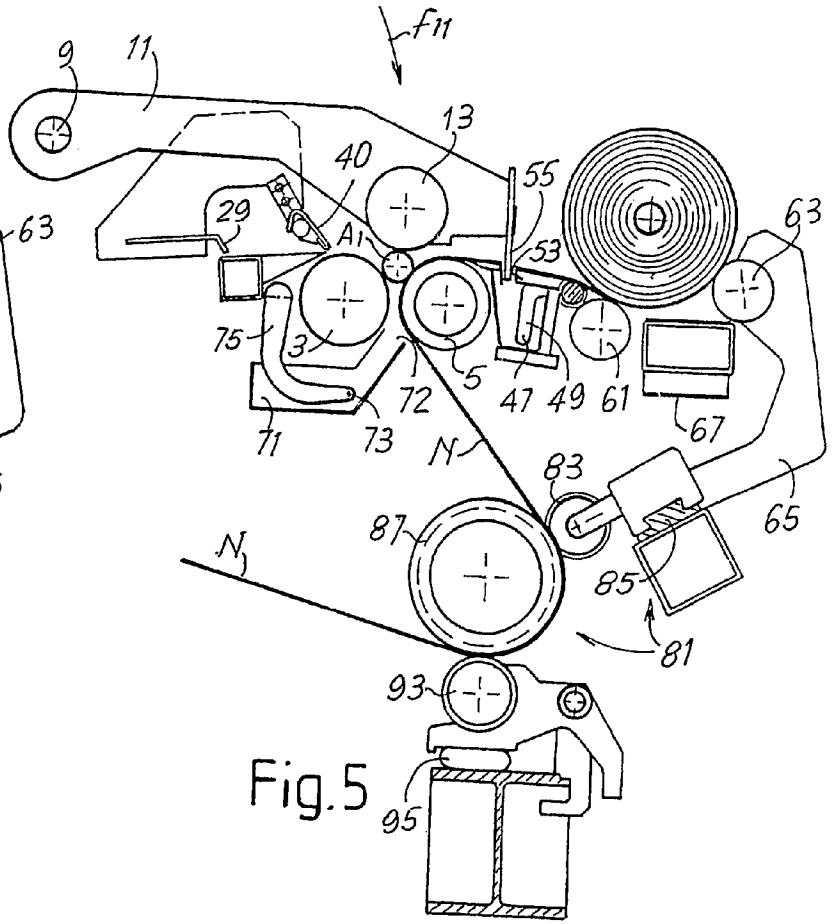
Figure 4:
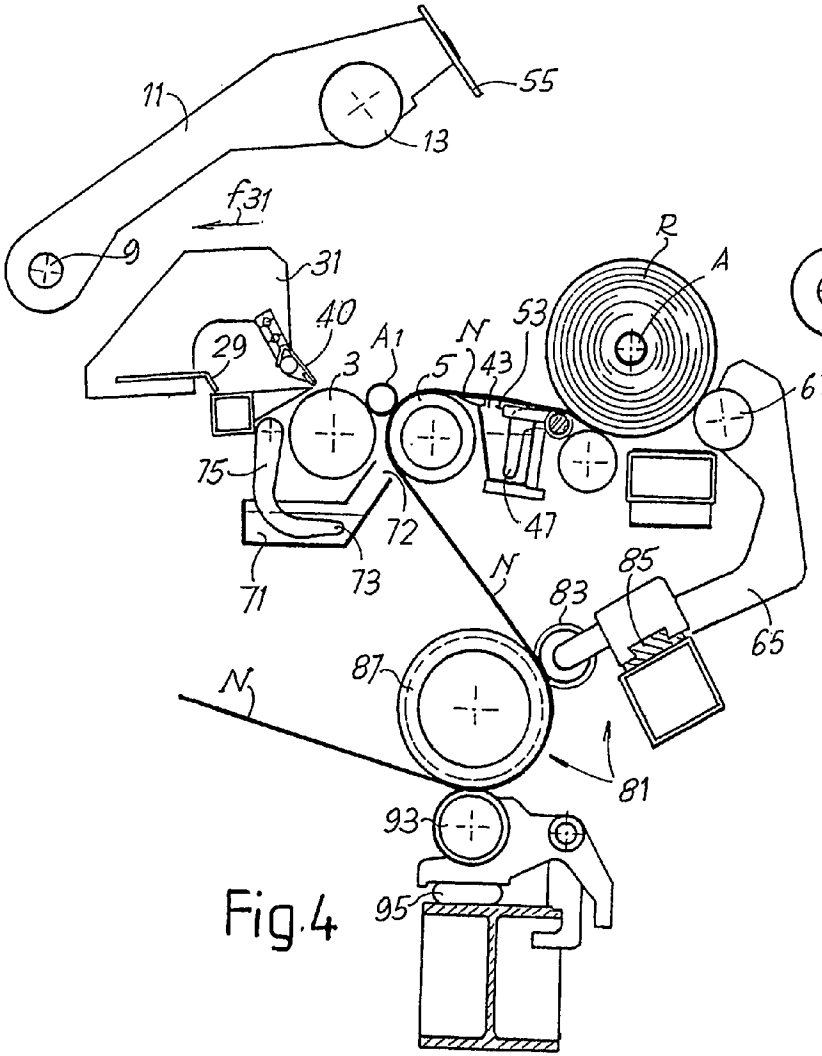
Figure 7:
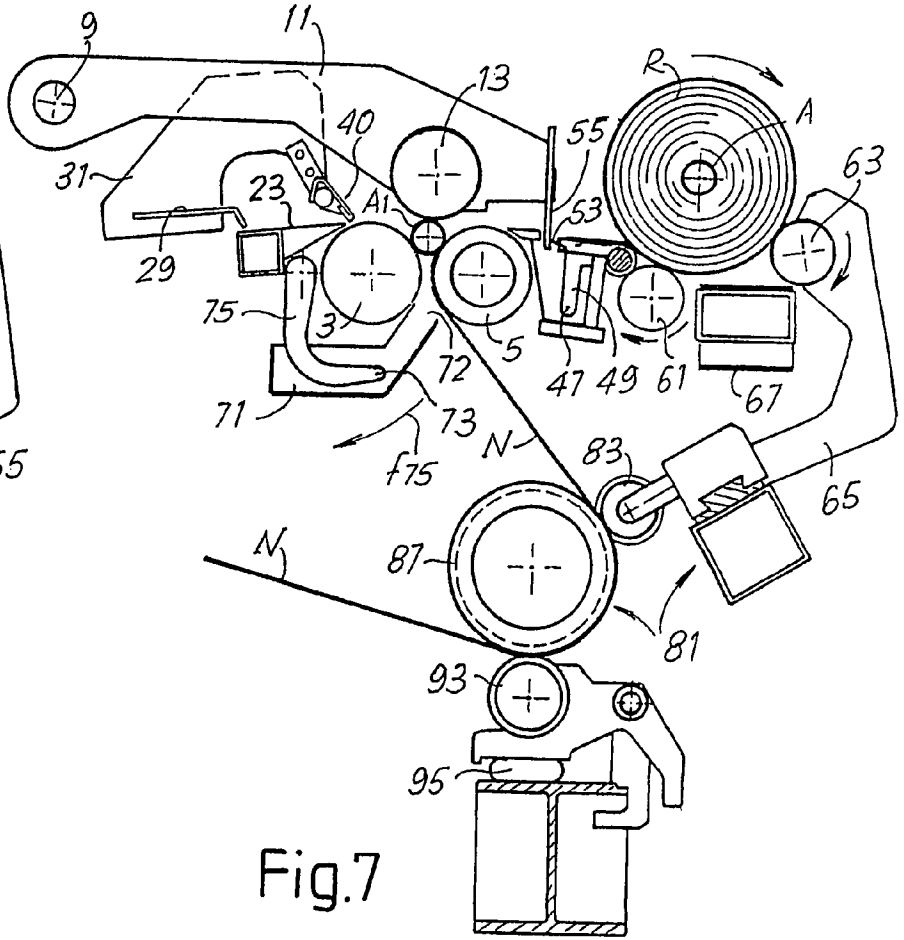

In the subsequent FIG. 4 the sides 31 have been returned to the initial position to remove the section 39 from the winding cradle 7. In this way the pair of oscillating arms 11 with the roller 13 and the movable element 55 carried by them can be made to oscillate downwards. The oscillating movement brings the winding roller 13 into contact with the new core A1 in the winding cradle and the movable element 55 is inserted into the aperture 43 in the unloading surface 41, as shown in FIG. 5. This movement to insert the movable element 55 into the aperture 43 causes severing or cutting of the web material which, due to rolling of the log R formed from the winding cradle 7 to the gluing position, is unwound from the winding roller 5 to the roller 61. The web material is thus severed through the effect of cooperation between the movable element 55 and the serrated blade 53.

Figure 6:
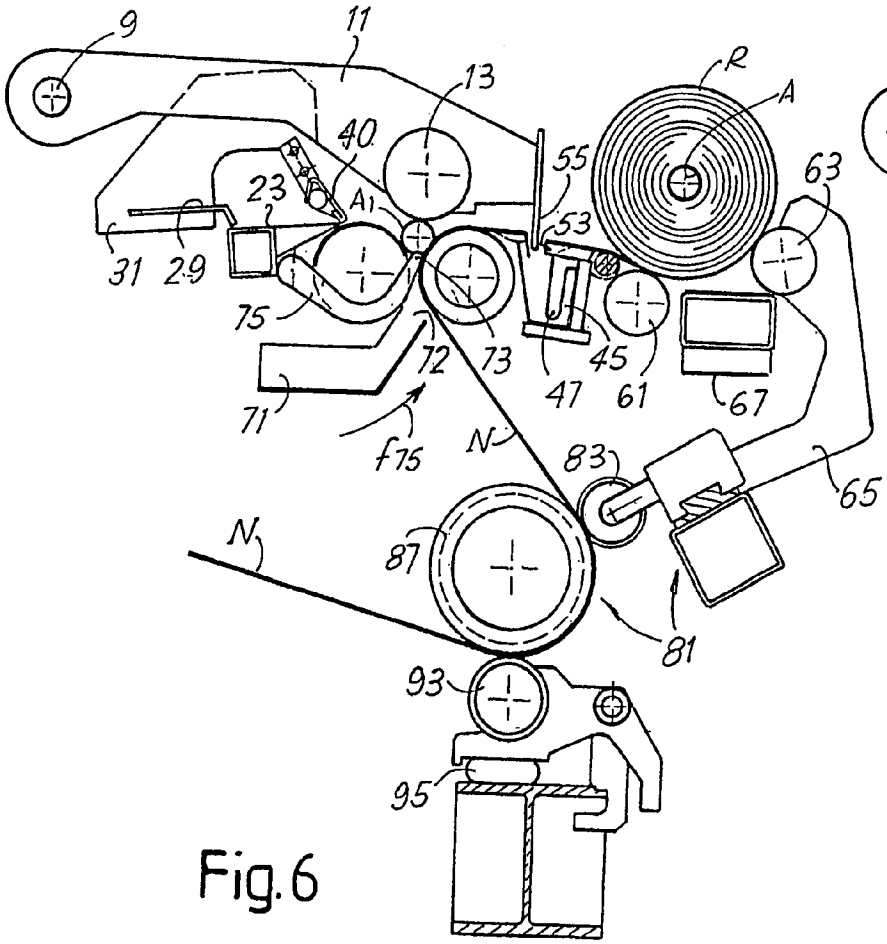

In FIG. 6 the glue dispenser 73 has been raised to apply a strip of glue to the core Al (or to the aligned cores) in the winding cradle 7. Subsequently, the glue dispenser 73 is lowered again and the winding rollers 3, 5, 7 start to rotate counter-clockwise to cause rotation of the core A1 in the winding cradle 7 and consequently feed of the web material around the core. The web material nipped between the winding roller 5 and the new core A1 adheres to the latter through the effect of the glue applied. The portion of web material between the movable element 55 that performed the cut of the web material and the core A1 is wound around the new core.

The distance between the movable element 55 inserted into the aperture 43 and the serrated blade 53 can be such to allow the elongated element 47 of the first glue dispenser to pass between the former two members. In this way the elongated element 47 of the first glue dispensing member can already be lifted from the glue container 45 when the machine is in the position in FIG. 7.

Figure 8:
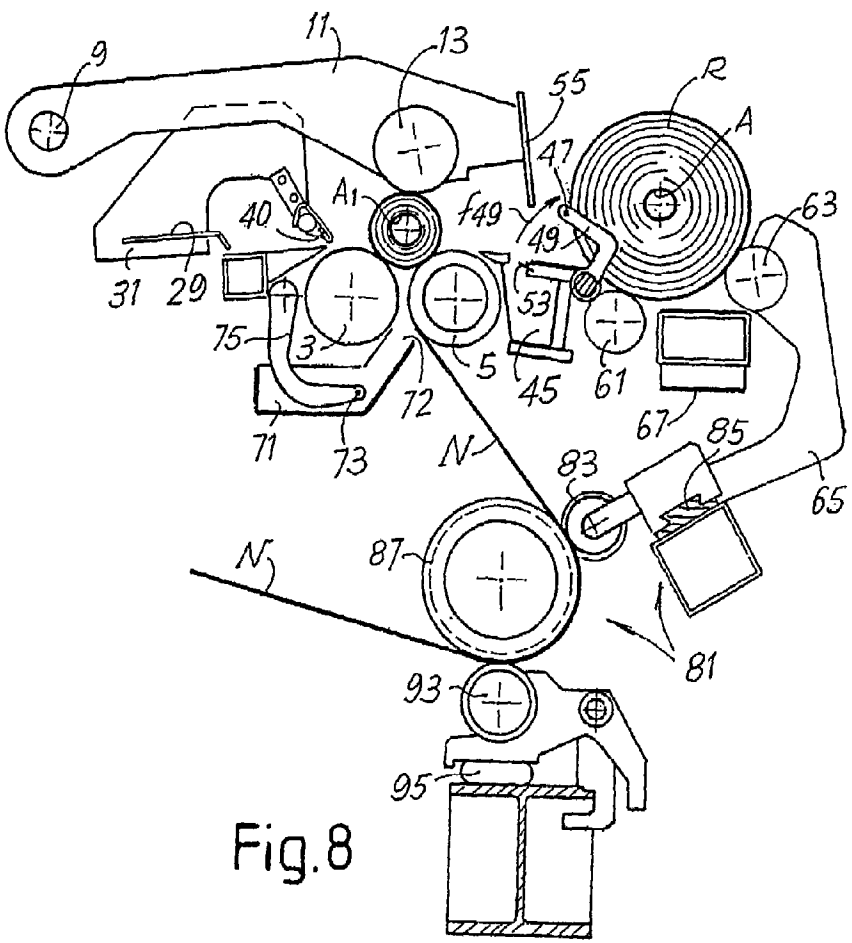

Nonetheless, in the example shown this movement to list the elongated element 47 of the first glue dispenser is performed after the new log being formed around the winding core A1 has increased in diameter enough to lift the winding roller 13 and therefore the arms 11 that carry it to an extent that removes the element 55 from the aperture 43, as shown in FIG. 8.

At this point the elongated element 47 of the first glue dispenser is removed from the container 45 with an oscillating movement of the arms 49 around the axis 51. The elongated element 47 is made to oscillate clockwise until it touches a certain point of the periphery of the log R which is in the gluing position. The position in which the glue is transferred from the elongated element 47 to the surface of the log R is such that subsequent winding of the trailing edge produced by severing the web material makes the trailing edge adhere to the log covering the glue.

Figure 9:
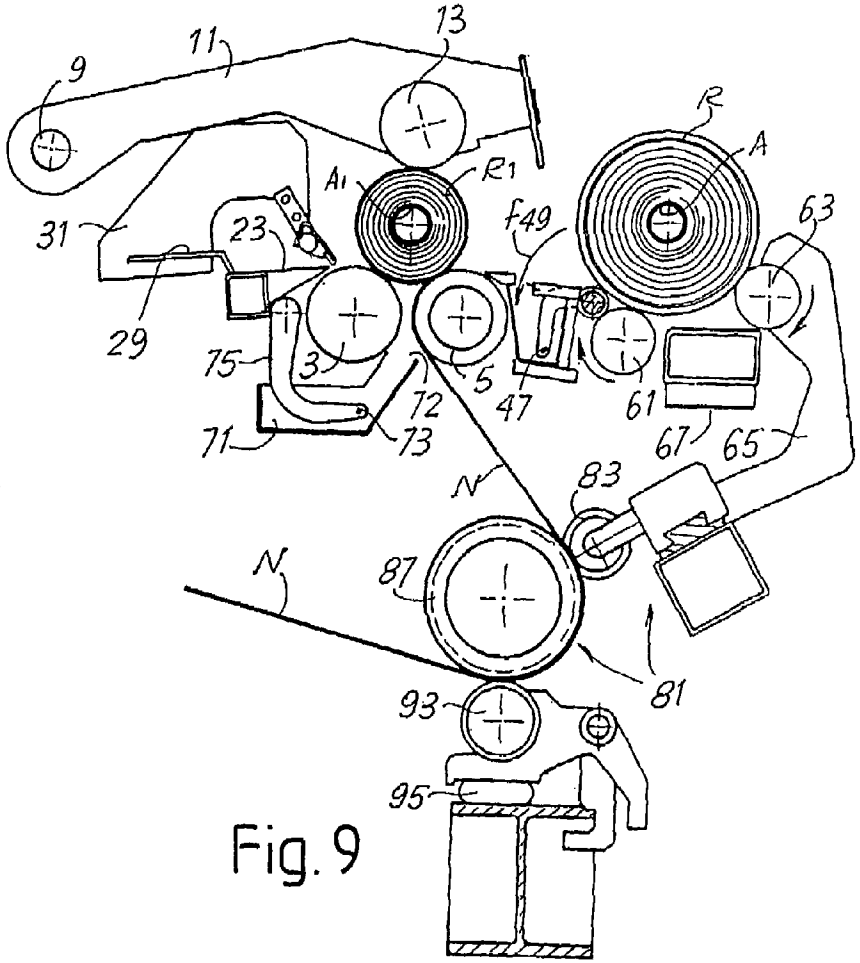

In FIG. 9 the first movable gluing member has been returned to its initial position inside the container 45, while the rollers 61 and 63 are made to rotate clockwise to cause counter-clockwise rotation of the log R in the gluing position and therefore rewinding of the trailing edge of the web material to cover the strip of glue applied to the surface of the log by the elongated element 47.

Finally, while the new log of web material continues to be wound on the new core A1, the previously formed log is carried to the conveyor belt 67 by means of clockwise oscillation of the arm 65 and of the roller carried by it. The conveyor belt removes the log formed and glued from the rewinding machine to allow subsequent treatment of a new log.

FIGS. 12A-12E and 13A-13B show a modified embodiment of the rewinding machine according to the invention. Similar or equivalent parts and elements are designated with the same reference numbers as in the previous figures. The two main differences of the machine according to this second embodiment are the following.

Firstly, the movable element 55 is supported by a pair of oscillating arms 11, which pivot about axis 9, but which do not support movable roller 13. The latter is supported by an auxiliary pair of oscillating arms 11A, pivoted about the same axis 9, even though the pivoting axes for arms 11 and 11A might be different. As will become apparent from the sequence of steps depicted in FIGS. 12A-12E, this allows the oscillation movement of the winding roller 13 to be independent from the movement of the movable severing element 55. For example, comparing FIGS. 12C and 12D, it can be seen that the movable element 55 has been raised after web severing while the roller 13 with the respective arms 11A is still in the lower position. Separating the movement of movable element 55 and roller 13 provides more operating flexibility, even though it increases the structural complexity of the machine to some extent. It could be useful, e.g. when cores of variable diameters are to be used. In this case if a single pair of oscillating arms were used to support the roller 13 and the movable element 55, severing of the web material N might be obtained for small diameter cores but not when large diameter cores are used, because the movable element 55 would then not be able to reach the proper severing position. By adopting independent oscillating arms 11, 11A this limitation is avoided.

The second difference vis-à-vis the previous embodiment is in the structure of the elongated aperture 43 provided along chute 41. In this case, the aperture 43 into which the movable element 55 penetrates to cut or sever the web material N is separate from a different aperture 43A which is provided, parallel to aperture 43, to allow the passage of the movable glue dispensing member 47. While the aperture 43 is in the form of a channel, i.e. it does not extend across the thickness of the chute 41, the aperture 43A extends across the whole thickness of the chute 41 to provide a passage for said dispensing member 47.

A serrated blade similar to blade 53 could be arranged along one of the edges of aperture 47. In the depicted embodiment, however, further difference is to be seen in the shape of the movable element 55. While in the previous embodiment the lower portion of the movable element 55 was substantially in the form of a blade, which co-acts with the fixed serrated blade 53, somewhat in a scissors fashion, in the embodiment of FIGS. 12A-12E, 13A, 13B the movable element 55 is provided with a rigid element 58 extending in a direction orthogonal to the web material, and provided with two pressing strips 56 made of resilient material, such as rubber. These strips might be hollow to become more yieldable. The strips 56 project downwards farther than rigid member 58.

Figure 13A:
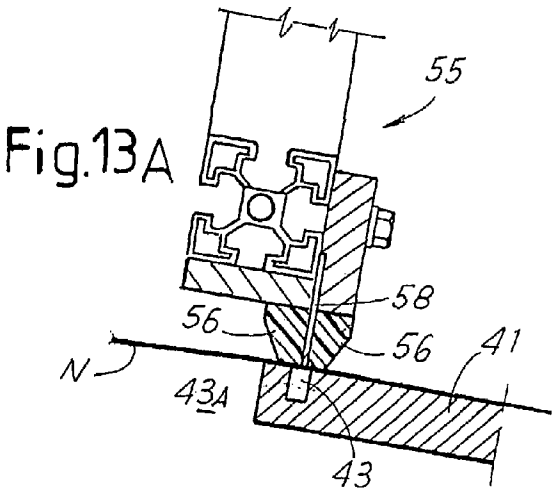
FIGS. 13A and 13B show an enlargement of the web severing means in of said second embodiment.
Figure 13B:
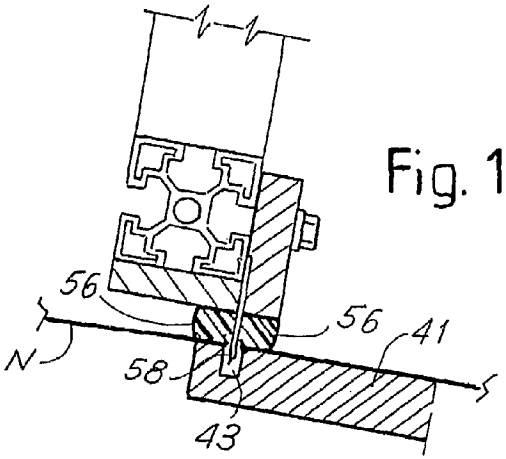
Figure 12E:
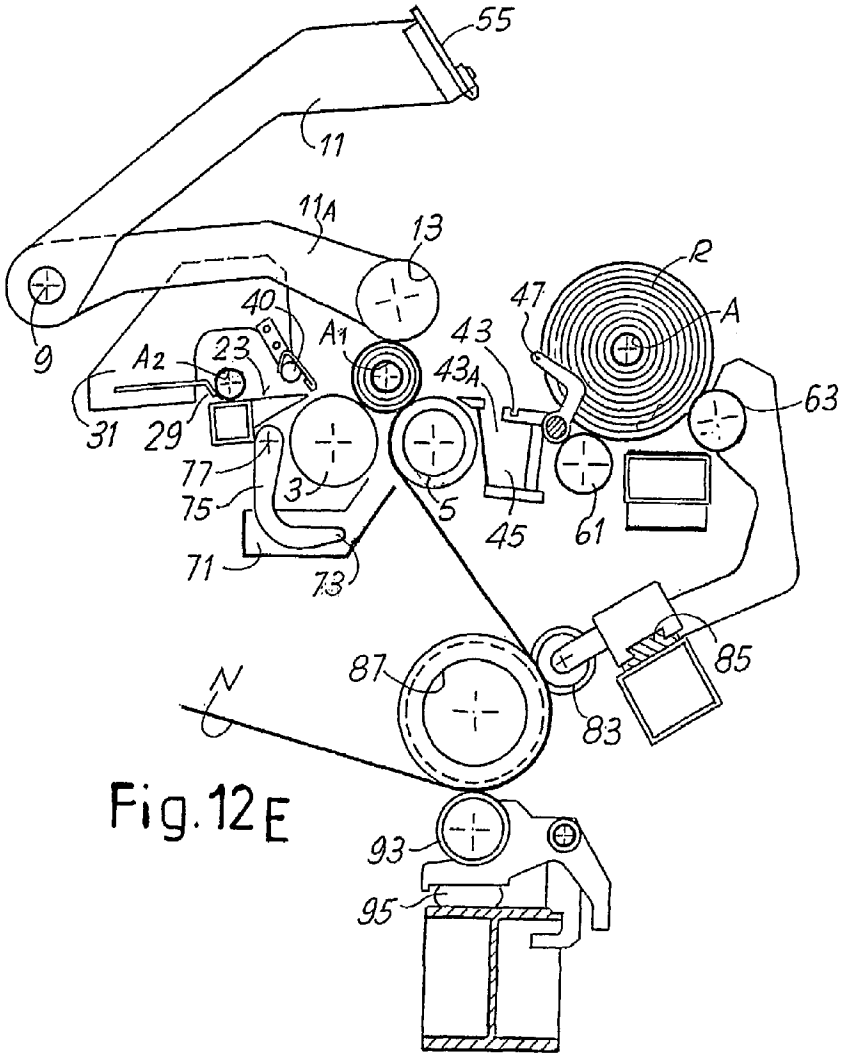

As can easily be appreciated from FIGS. 13A, 13B, during cutting the strips 56, contact the web material N prior to the contact thereof by rigid member 58. The web material N is thus pressed against the surface of the chute 41 (FIG. 13A) and blocked. By further lowering the movable member 55 the strips 56 are compressed and the rigid member 58 enters the aperture or slot 43, thus cutting or tearing the web material N.

The various features which distinguish this second embodiment from the previous one can be variously combined. For example, the particular shape of the web severing device can be used also in the embodiment of FIGS. 1-11, or the dual oscillating arm arrangement 11, 11A of FIGS. 12A-12E could be used in conjunction with the structure of the movable element 55 as depicted in FIGS. 1-11.

It is understood that-the drawing purely shows a possible embodiment of the invention, the forms and layouts of which may vary without however departing from the scope of the concept on which the invention is based. The presence of any reference numbers in the appended claims has the sole purpose of facilitating their reading in the light of the description hereinbefore and of the accompanying drawings and does not limit the scope of protection.

The invention claimed is:

1. Rewinding machine to produce logs of web material comprising:

a winding cradle;

an insertion member to insert a winding core into said winding cradle;

an ejector to eject a log formed in said winding cradle by causing the log to roll on an unloading chute;

a severing device to sever the web material after the log is ejected from said winding cradle;

wherein disposed along the unloading chute is an aperture elongated in a direction transverse to a direction in which the log is unloaded along said unloading chute;

said severing device comprises a movable element that is inserted into said aperture to cause severing of the web material between the winding cradle and the log of wound web material, and a first glue container is disposed underneath said unloading chute and wherein a first movable dispensing member that collects glue from said first glue container to apply the glue to the log of wound web material is associated with said first glue container.

2. The rewinding machine as claimed in claim 1, wherein said severing device further comprises a blade applied along said aperture with which said movable element cooperates.

3. The rewinding machine as claimed in claim 2, wherein said blade is fitted along an edge of said aperture disposed downstream with respect to a movement to unload the log on said chute.

4. The rewinding machine as claimed in claim 2 or 3, wherein said blade is serrated.

5. The rewinding machine as claimed in claim 1, further comprising rewinding means to wind a trailing edge of the log after the glue has been applied.

6. The rewinding machine as claimed in claim 5, wherein said rewinding means define a stop position of the log ejected onto said unloading chute, the glue being applied to the log when the log is in said stop position.

7. The rewinding machine as claimed in claim 5, wherein said rewinding means include a pair of rewinding rollers.

8. The rewinding machine as claimed in claim 7, wherein a first one of said rewinding rollers is supported by a pair of oscillating arms to be carried from an active position to a disabled position.

9. The rewinding machine as claimed in claim 8, wherein a conveyor is disposed between the disabled position of said first one of said rewinding rollers and a second one of said rewinding rollers to move the log of wound web material away in a direction parallel to an axis of the log.

10. The rewinding machine as claimed in claim 1, wherein said aperture has a width in a direction in which said log is unloaded such that when the movable element of the severing device is in said aperture, said first movable dispensing member can pass through said aperture.

11. The rewinding machine as claimed in claim 1, wherein said movable element is carried by a pair of oscillating arms.

12. The rewinding machine as claimed in claim 11, wherein said pair of oscillating arms supports a winding roller with movable axis.

13. The rewinding machine as claimed in claim 1, wherein a second glue container is disposed underneath said winding cradle and wherein a second movable dispensing member to apply a glue to the winding core when the winding core is in said winding cradle, is associated with said second glue container.

14. The rewinding machine as claimed in claim 13, wherein said second movable dispensing member comprises an elongated member provided with an oscillating movement.

15. The rewinding machine as claimed in claim 1, wherein said first movable dispensing member comprises an elongated member provided with an oscillating movement.

16. The rewinding machine according to claim 1, wherein said first glue container is arranged underneath said aperture.

17. The rewinding machine according to claim 16, wherein said movable dispensing member moves from said first glue container towards said log and passes through said aperture into which said movable element enters to sever the web material.

18. The rewinding machine according to claim 1 or 16, wherein along said unloading chute a second aperture is provided, arranged parallel to said aperture into which said movable element enters to sever said web material, said second aperture providing a passage for said first movable glue dispensing member.

19. Rewinding machine to produce logs of web material comprising:

a winding cradle;

an insertion member to insert a winding core into said winding cradle;

an ejector to eject a log formed in said winding cradle by causing the log to roll on an unloading chute;

a severing device to sever the web material after the log is ejected from said winding cradle; wherein disposed along the unloading chute is an aperture elongated in a direction transverse to a direction in which the log is unloaded along said unloading chute;

said severing device comprises a movable element that is inserted into said aperture to cause severing of the web material between the winding cradle and the log of wound web material, an insertion surface for the winding core is disposed on an opposed side of said winding cradle with respect to the unloading chute, said insertion member being constructed and arranged to push the winding core along said insertion surface towards said winding cradle, and said ejector and said insertion member are integral with each other.

20. Rewinding machine to produce logs of web material comprising:

a winding cradle;

an insertion member to insert a winding core into said winding cradle;

an ejector to eject a log formed in said winding cradle by causing the log to roll on an unloading chute;

a severing device to sever the web material after the log is ejected from said winding cradle; wherein disposed along the unloading chute is an aperture elongated in a direction transverse to a direction in which the log is unloaded along said unloading chute;

said severing device comprises a movable element that is inserted into said aperture to cause severing of the web material between the winding cradle and the log of wound web material, and said ejector and said insertion member are integral with each other.

21. The rewinding machine as claimed in claim 19 or 20, wherein said insertion member is provided with a translatory movement.

22. The rewinding machine as claimed in claims 19 or 20, wherein said ejector comprises a pair of sides between which a pusher section extends to eject the log of wound web material from said cradle, and with which the insertion member is integral, the ejector and the insertion member being spaced from each other in a direction of movement to insert the winding core and to eject the log, and wherein means to feed the winding core are provided to position said winding core in an intermediate position between the insertion member and the ejector.

23. The rewinding machine as claimed in claim 22, wherein said means to feed the winding core comprise a channel to drop the winding core, defining an insertion trajectory orthogonal to an axis of said winding core.

24. The rewinding machine as claimed in claim 23, wherein said means to feed the cores further comprise a conveyor that inserts said winding core with a movement parallel to the axis of said winding core.

25. the rewinding machine as claimed in claim 24, wherein said conveyor comprises a belt conveyor.

26. The rewinding machine as claimed in claim 1, 12 or 20, further comprising a plurality of cutting knives to cut the web material along longitudinal cutting lines, cooperating with respective counter-blades constituted by a plurality of annular channels produced on a counter-roller.

27. The rewinding machine as claimed in claim 26, further comprising a series of ply-bonding members, cooperating with said counter-roller.

28. The rewinding machine as claimed in claim 1, 12 or 20, wherein said winding cradle is formed of a pair of winding rollers.

29. The rewinding machine according to claim 1, 12 or 20, wherein said movable element includes a severing member and yieldable side members.

30. The rewinding machine according to claim 1, 12 or 20, wherein said movable element is carried by a first pair of oscillating arms and wherein a second pair of oscillating arms is provided which carry a third winding roller.

31. Method of producing logs of web material, comprising:

inserting at least one first winding core into a winding cradle;

winding a pre-established quantity of web material around said at least one first winding core to form a log;

unloading the log from said winding cradle along an unloading chute;

inserting at least one second winding core into said winding cradle;

severing the web material between said log and said at least one second winding core by means of a severing device; wherein disposed along said unloading chute is an aperture, elongated in a direction transverse to a direction in which the log is unloaded along said unloading chute;

severing said web material by a movable element of said severing device by inserting said movable element into said aperture, and a first glue container is disposed underneath said aperture; and a glue is applied by a first movable dispensing member to the log unloaded onto said unloading chute, said first movable dispensing member collecting the glue from said first container.

32. The method as claimed in claim 31, wherein said movable element cooperates with a blade fitted along said aperture to sever the web material.

33. The method as claimed in claim 31, wherein a movable winding roller is brought into contact with said at least one second winding core.

34. The method as claimed in claim 31, wherein said movable element is moved in said aperture to sever the web material simultaneously to said movable winding roller when the movable winding roller is brought into contact with the at least one second winding core.

35. Method of producing logs of web material, comprising:

inserting at least one first winding core into a winding cradle;

winding a pre-established quantity of web material around said at least one first winding core to form a log;

unloading the log from said winding cradle along an unloading chute;

inserting at least one second winding core into said winding cradle;

severing the web material between said log and said at least one second winding core by means of a severing device; wherein disposed along said unloading chute is an aperture, elongated in a direction transverse to a direction in which the log is unloaded along said unloading chute;

severing said web material by a movable element of said severing device by inserting said movable element into said aperture, applying a glue to said at least one second winding core when the at least one second winding core is in the winding cradle, and winding is started on said at least one second winding core while the severing device is still in a severing position.

36. Method of producing logs of web material, comprising:

inserting at least one first winding core into a winding cradle;

winding a pre-established quantity of web material around said at least one first winding core to form a log;

unloading the log from said winding cradle along an unloading chute;

inserting at least one second winding core into said winding cradle;

severing the web material between said log and said at least one second winding core by means of a severing device; wherein disposed along said unloading chute is an aperture, elongated in a direction transverse to a direction in which the log is unloaded along said unloading chute;

severing said web material by a movable element of said severing device by inserting said movable element into said aperture, applying a glue to said at least one second winding core when the at least one second winding core is in the winding cradle, and the glue is applied to the at least one second winding core by a second movable dispensing member that collects glue from a second glue container disposed underneath said winding cradle.

37. Method of producing logs of web material, comprising:

inserting at least one first winding core into a winding cradle;

winding a pre-established quantity of web material around said at least one first winding core to form a log;

unloading the log from said winding cradle along an unloading chute;

inserting at least one second winding core into said winding cradle;

severing the web material between said log and said at least one second winding core by means of a severing device; wherein disposed along said unloading chute is an aperture, elongated in a direction transverse to a direction in which the log is unloaded along said unloading chute;

severing said web material by a movable element of said severing device by inserting said movable element into said aperture, and unloading the log from said winding cradle and inserting said at least one second winding core into said winding cradle by an ejector and an insertion member, respectively, which are integral with each other.

38. Rewinding machine to produce logs of web material comprising:

a winding cradle;

an insertion member to insert a winding core into said winding cradle;

an ejector to eject a log formed in said winding cradle by causing the log to roll on an unloading chute;

severing device to sever the web material after the log is ejected from said winding cradle; wherein a glue container is arranged underneath said winding cradle, and wherein a movable dispensing member is associated with said glue container to apply a glue to the winding core when the winding core is in said winding cradle; and wherein disposed along the unloading chute is an aperture elongated in a direction transverse to a direction in which the log is unloaded along said unloading chute;

said severing device comprises a movable element that is inserted into said aperture to cause severing of the web material between the winding cradle and the log of wound web material;

said movable element is carried by a pair of oscillating arms; and said pair of oscillating arms supports a winding roller with movable axis.

39. Method of producing logs of web material, comprising:

inserting at least one first winding core into a winding cradle;

winding a pre-established quantity of web material around said at least one first winding core to form a log;

unloading the log from said winding cradle along an unloading chute;

inserting at least one second winding core into said winding cradle;

severing the web material between said log and said at least one second winding core by means of a severing device; wherein disposed along said unloading chute is an aperture, elongated in a direction transverse to a direction in which the log is unloaded along said unloading chute;

severing said web material by a movable element of said severing device by inserting said movable element into said aperture;

applying a glue to said at least one second winding core when the at least one second winding core is in the winding cradle; and the glue is applied simultaneously on substantially an entire length of the winding core by a movable dispensing member which obtains the glue from a glue container disposed underneath the winding cradle.

40. The method as claimed in claim 36 or 39, wherein said glue is applied to the at least one second winding core during severing of the web material.

41. The method as claimed in claim 36 or 39, wherein said at least one second winding core is disposed at an insertion surface positioned, with respect to the winding cradle, on a side opposed to said unloading chute, before unloading the log from the winding cradle.

42. The method as claimed in claim 36 or 39, wherein said web material is formed of at least two plies; wherein said at least two plies are bonded together by ply-bonding; and wherein the web material is divided into a plurality of longitudinal strips before winding.

43. The method as claimed in claim 42, wherein the web material is divided by cutting the web material using a series of cutting knives cooperating with a single counter-roller, which is provided with annular grooves forming counter-blades for said cutting knives, separated from one another by annular projections at least some of which cooperate with gripping members.

44. Method according to claim 43, wherein said web material is retained during said cutting by pressing the web material near edges of said aperture.

* * * * *